US005712610A

United States Patent [19]

Takeichi et al.

[11] Patent Number: 5,712,610

[45] Date of Patent: Jan. 27, 1998

[54] PROTECTIVE DEVICE

[75] Inventors: Motohide Takeichi; Norikazu Iwasaki; Yuji Furuuchi, all of Kanuma, Japan

[73] Assignee: Sony Chemicals Corp., Tokyo, Japan

[21] Appl. No.: 562,685

[22] Filed: Nov. 27, 1995

[30] Foreign Application Priority Data

Nov. 30, 1994 [JP] Japan ..... 6-323559

[51] Int. Cl.[6] ..... H01H 85/04

[52] U.S. Cl. ..... 337/290; 337/297; 337/416

[58] Field of Search ..... 337/152, 153, 337/160, 182, 183, 184, 185, 221, 290, 297, 416

[56] References Cited

FOREIGN PATENT DOCUMENTS 0 078 165 5/1983 European Pat. Off. .
0 096 834 12/1983 European Pat. Off. .
WO-A-9523423 8/1995 WIPO .

*Primary Examiner*—Leo P. Picard
*Assistant Examiner*—Jayprakash N. Gandhi
*Attorney, Agent, or Firm*—Hill, Steadman & Simpson

[57] ABSTRACT

To obtain a protective device that can prevent overvoltage and at the same time has an excellent safety and also to make chip type protective devices smaller in size, this invention provides a protective device comprising a substrate, a heating element provided on the substrate, an insulating layer that covers the surface of the heating element, and a low-melting metal piece provided on the insulating layer. Particularly preferably the substrate and the heating element are each formed of an inorganic material. This protective device may be used in combination with a voltage detecting means making use of a zener diode, in such a way that the heating element of the protective device is electrically excited to generate heat when the voltage detecting means detects a voltage exceeding the rated voltage, whereby an overvoltage protector can be set up.

15 Claims, 10 Drawing Sheets

PROTECTIVE DEVICE

BACKGROUND OF THE INVENTION

1. Field of the Invention

This invention relates to a protective device making use of a low-melting metal piece such as a fuse. More particularly, this invention relates to a protective device useful for preventing an overvoltage, a voltage exceeding the rated operating voltage.

2. Description of the Related Art

As protective devices making use of a low-melting metal piece made of lead, tin, antimony or the like, electric current fuses which blow upon flow of an overcurrent to break the current have been hitherto widely used. Such fuses are known to have various forms, including a link fuse, which is formed of a flat rectangular low-melting metal piece provided with fastenings at its both ends; a cartridge fuse, which is formed of a rod-like low-melting metal piece enclosed in a glass tube; and a chip type fuse, which is formed of a rectangular solid form low-melting metal piece provided with a lead terminal. Besides these, temperature fuses which blow at temperatures exceeding given temperatures are also used as protective devices.

All types of the conventional protective devices, however, have the problem that they can be mounted on wiring substrates with difficulty. As a countermeasure therefor, a chip type fuse is proposed in which a fuse is buried and enclosed in a resin of a rectangular solid form and a lead terminal of the fuse is formed on the surface of the resin of a rectangular solid form (Japanese Patent Application Laid-open No. 4-192237). However, if the fuse is merely buried and enclosed in resin, the fuse may melt when an overcurrent flows, but does not necessarily blow. Thus, there is the problem that such a fuse can not afford to stably function as a protective device.

As to the size of commercially available chip type fuses, they are approximately 2.6 mm thick×2.6 mm wide×6 mm long even for those of a smaller size, and have a size larger than other electronic parts mounted on a substrate. In particular, the thickness of the chip type fuses is as very large as about 2.6 mm, while the thickness of ICs is commonly about 1 mm. Hence, it follows that the height of a substrate after packaging is restricted by the chip type fuse. This hinders the achievement of decrease in packaging space. Accordingly, it has been a subject how the thickness of the chip type fuse also is made as small as about 1 mm.

With recent development of industries, in addition to the conventional electric current fuses and temperature fuses, it has become sought to provide a protective device that acts upon overvoltage.

For example, in lithium ion cells attracting notice as secondary cells with a high energy density, a dendrite is produced on the surface of the electrode as a result of overcharging to greatly damage cell performance, and hence, when cells are charged, it is necessary to prevent them from being charged beyond the rated voltage. However, no protective devices useful for preventing such overcharging have been hitherto developed. In practice, as a protective mechanism for lithium ion cells, a protective mechanism is provided which is so designed that, when electric currents exceeding the rated value flow through the cell, a PTC (positive temperature coefficient resistor) generates heat and a fuse blows. Such a protective mechanism, however, can not be used to prevent overcharging. Hence, it is sought to provide a new protective device for preventing overcharging.

SUMMARY OF THE INVENTION

The present invention intends to solve the problems involved in the prior art relating to fuses. A first object thereof is to provide a new protective device that can prevent overvoltage. A second object thereof is to make chip type protective devices, including conventional electric current fuses, smaller in size while ensuring their stable operation.

The present inventors have discovered that a device comprising a substrate and superposingly provided thereon a heating element, an insulating layer and a low-melting metal piece in this order is useful as an overvoltage-preventive protective device. Thus they have accomplished a protective device as a first mode of the present invention.

In this embodiment, they have also discovered that the stability of the protective device can be greatly improved when the substrate and the heating element are each formed of an inorganic material. Thus they have accomplished a particularly preferred embodiment according to the first mode of the invention.

They have also discovered that protective devices including not only the overvoltage-preventive protective device but also conventional electric current fuses can be made small-sized without damaging their function, when a chip type protective device is formed by providing a low-melting metal piece on a substrate, thereafter sealing the low-melting metal piece with a material having a lower melting point or lower softening point than the low-melting metal piece, and further covering its outer surface with an outside casing, leaving a gap (empty space) between them. Thus they have accomplished a protective device according to a second mode of the invention.

More specifically, as a protective device according to the first mode of the invention, the present invention provides a protective device comprising a substrate, a heating element provided on the substrate, an insulating layer that covers the surface of the heating element, and a low-melting metal piece provided on the insulating layer.

As a particularly preferred embodiment thereof, the present invention provides a protective device comprising an inorganic substrate, a heating element formed of an inorganic material, provided on the substrate, an insulating layer that covers the surface of the heating element, and a low-melting metal piece provided on the insulating layer.

As an overvoltage protector making use of such a protective device, the present invention also provides an overvoltage protector comprising the above protective device and a voltage detecting means; the heating element of the protective device being electrically excited to generate heat when the voltage detecting means detects a voltage exceeding the rated voltage.

As a protective device according to the second mode of the invention, the present invention still also provides an overcurrent-preventive protective device comprising a substrate, a low-melting metal piece provided on the substrate, an inner sealing portion which is formed of a material having a lower melting point or lower softening point than the low-melting metal piece and seals the low-melting metal piece, and an outside casing that covers the inner sealing portion, leaving a gap between the outside casing and the inner sealing portion.

DETAILED DESCRIPTION OF THE INVENTION

Figure 1A:
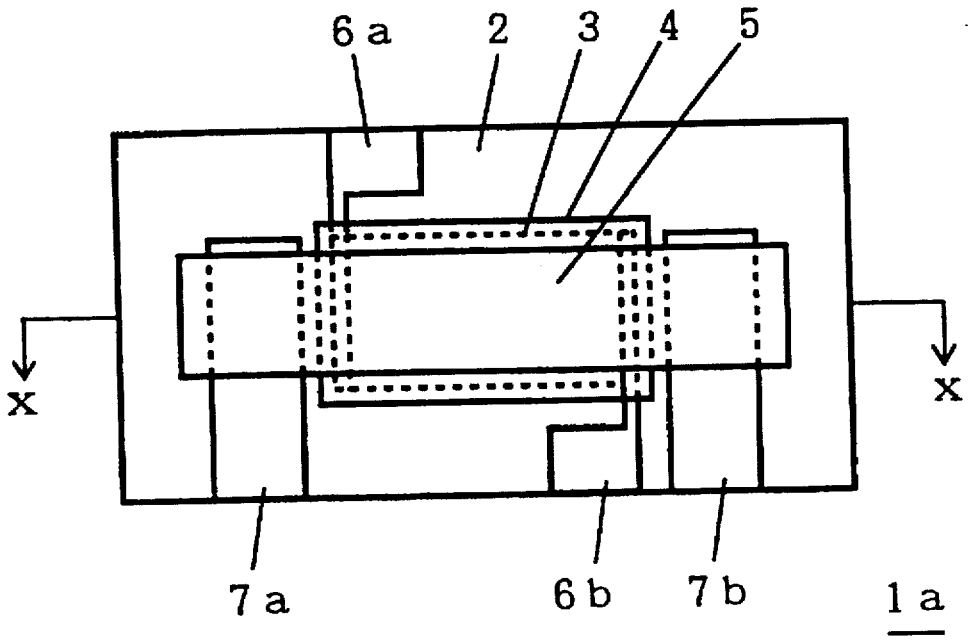
FIGS. 1A and 1B are a plan view and an X—X cross section, respectively, of a protective device of the present invention.
Figure 1B:
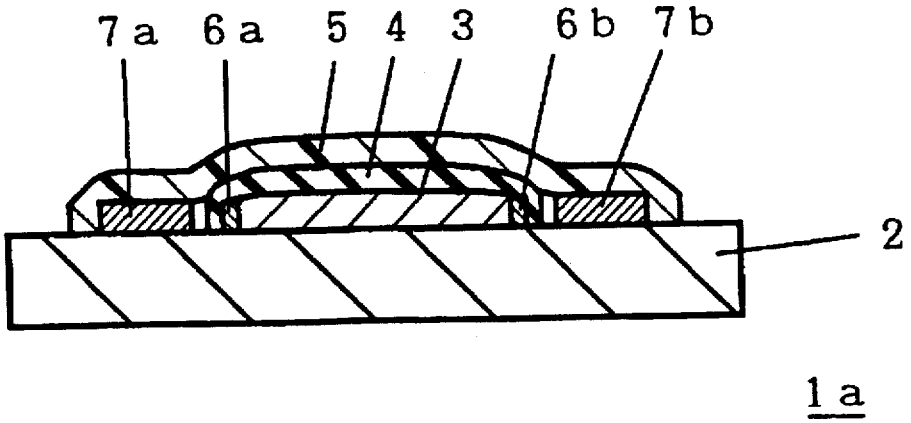

FIGS. 1A and 1B illustrate a basic embodiment of the protective device according to the first mode of the invention. As shown in FIG. 1A, a plan view, and FIG. 1B, an X—X cross section, this protective device, denoted as 1*a*, comprises a substrate 2, a heating element 3 provided on the substrate, an insulating layer 4 that covers the surface of the heating element 3, and a low-melting metal piece 5 provided on the insulating layer 4. Here, the heating element 3 and the low-melting metal piece 5 are connected to heating element terminals 6*a* and 6*b* and low-melting metal piece terminals 7*a* and 7*b*, respectively.

In the present invention, as the substrate 2 of such a protective device, it is possible to use a substrate of an organic type, formed of plastic film, glass epoxy resin or the like, or a substrate of an inorganic type such as a ceramic substrate or a metal substrate. It is preferable to use a substrate of an inorganic type. There are no particular limitations on the thickness of the substrate 2. From the viewpoint of making the protective device small in size, the substrate may preferably be in a thickness of approximately from 0.1 mm to 1.0 mm in usual instances.

The heating element 3 has a useful function that it serves as a heat source for causing the low-melting metal piece to blow when, as will be described later, the protective device la is used in combination with a voltage detecting means such as a zener diode so that it can function as an overvoltage-preventive protective device. In the present invention, the heating element 3 may be formed of an organic material or an inorganic material, either of which may be used. For example, as the heating element formed of an organic material, a heating element comprising a thermosetting insulating resin and conductive particles dispersed therein may preferably be used. If it is a heating element comprising a thermoplastic resin and conductive particles dispersed therein, its resistance may greatly vary when the heating element is electrically excited and heated and the temperature exceeds the softening point of the resin, so that no stable performance can be achieved. As for the heating element formed of an inorganic material, a heating element comprising a conductive material such as ruthenium oxide or carbon black and an inorganic binder such as water glass may be used. As materials for such a heating element, commercially available inorganic resistive pastes may be used. The heating element 3 formed of an inorganic material can be readily formed by coating such an inorganic resistive paste on the substrate, followed by baking. Even when an organic component is contained in the resistive paste, the organic component is decomposed and removed in the course of baking. Hence, the resistive paste to be coated on the substrate may contain an organic component.

Thus, either the heating element formed of an organic material or the one formed of an inorganic material may be used as the heating element 3, while the use of the heating element 3 formed of not an organic material but an inorganic material makes it possible to greatly control the effects of heat upon the resistance of the heating element 3. Hence, even when the heating element 3 is kept electrically excited for a long time during the use of the protective device and the heating element 3 continues to generate heat, the state of such heat generation can be stable and no runaway may occur. Accordingly, it becomes possible to obtain a protective device having no danger of ignition due to excessive heat generation and having a superior safety. Also, the use of an inorganic substrate as the substrate 2 makes it possible to readily form the heating element 3 formed of an inorganic material, by coating a resistive paste on the substrate followed by baking. Since also the substrate itself can be inflammable, the safety in use of the protective device can be increased.

The insulating layer 4 is a layer that insulates the heating element 3 from the low-melting metal piece 5. There are no particular limitations on materials for this insulating layer 4. For example, it is possible to use various organic resins such as epoxy resins, acrylic resins and polyester resins, or inorganic materials mainly composed of $SiO_2$. When an organic resin is used in the insulating layer 4, an inorganic powder with a high thermal conductivity may be dispersed therein. This enables effective conduction of the heat of the heating element 3 at the time of its heat generation, to the low-melting metal piece 5. Such an inorganic powder is exemplified by boron nitride (thermal conductivity: 0.18 cal/cm.sec.°C.) and alumina (thermal conductivity: 0.08 cal/cm.sec.°C.), any of which may be used.

The low-melting metal piece 5 may be formed of any of various low-melting metals conventionally used for fuse materials. For example, it may be formed of any of alloys shown in Table 1.

TABLE 1

| Alloy Composition | Liquid-phase point (°C.) |
|---|---|
| Bi:Sn:Pb = 52.5:32.0:15.5 | 95 |
| Bi:Pb:Sn = 55.5:44.0:1.0 | 120 |
| Pb:Bi:Sn = 43.0:28.5:28.5 | 137 |
| Bi:Pb = 55.5:44.5 | 124 |
| Bi:Sn = 58.0:42.0 | 138 |
| Sn:Pb = 63.0:37.0 | 183 |
| Sn:Ag = 97.5:2.5 | 226 |

TABLE 1-continued

| Alloy Composition | Liquid-phase point (°C.) |
|---|---|
| Sn:Ag = 96.5:3.5 | 221 |
| Pb:In = 81.0:19.0 | 280 |
| Zn:Al = 95.0:5.0 | 282 |
| In:Sn = 52.0:48.0 | 118 |
| Pb:Ag:Sn = 97.5:1.5:1.0 | 309 |

The heating element terminals 6*a* and 6*b* and the low-melting metal piece terminals 7*a* and 7*b* can be formed in the same manner as electrode terminals usually formed on the substrate. For example, they may be formed by patterning of copper foil, by nickel plating and gold plating successively applied on a copper pattern, or by soldering on a copper pattern.

The protective device 1*a* as shown in FIG. 1 is produced by, for example, a process comprising forming terminals 6*a*, 6*b*, 7*a* and 7*b* on the inorganic substrate 2 by a conventional method, subsequently coating an inorganic resistive paste by screen printing or the like, followed by baking to form the heating element 3, coating an insulating resin on the surface of the heating element by printing or the like, followed by curing to form the insulating layer, and further bonding a low-melting metal foil onto the insulating layer 4 by hot pressing to provide the low-melting metal piece 5.

Alternatively, in the same production process as the above, the inorganic resistive paste may be replaced with a conductive paste comprised of a thermosetting resin and conductive particles to form the heating element.

As stated above, the protective device of the present invention may be constituted of the heating element 3 provided on the substrate 2 (particularly preferably the heating element 3 formed of an inorganic material, provided on the inorganic substrate 2), the insulating layer 4 and the low-melting metal piece 5. More preferably, as shown in FIGS. 2A and 2B or FIGS. 3A and 3B, the low-melting metal piece 5 may be sealed with an inner sealing portion 8 and its outer surface may be further covered with an outside casing or an outer sealing portion.

Figure 2A:
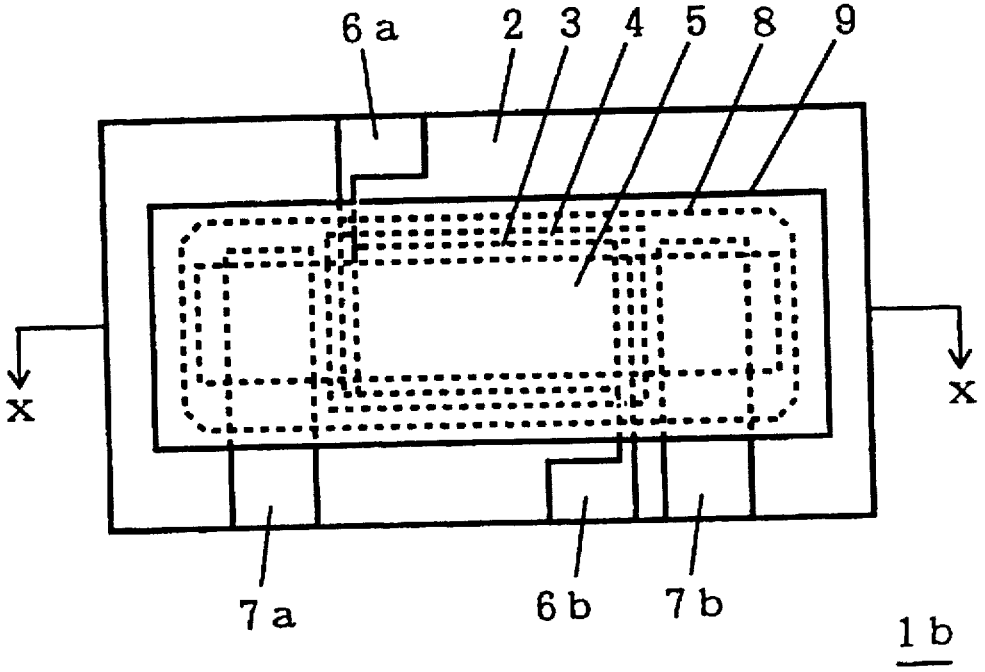
FIGS. 2A and 2B are a plan view and an X—X cross section, respectively, of a protective device according to another embodiment of the present invention.
Figure 2B:
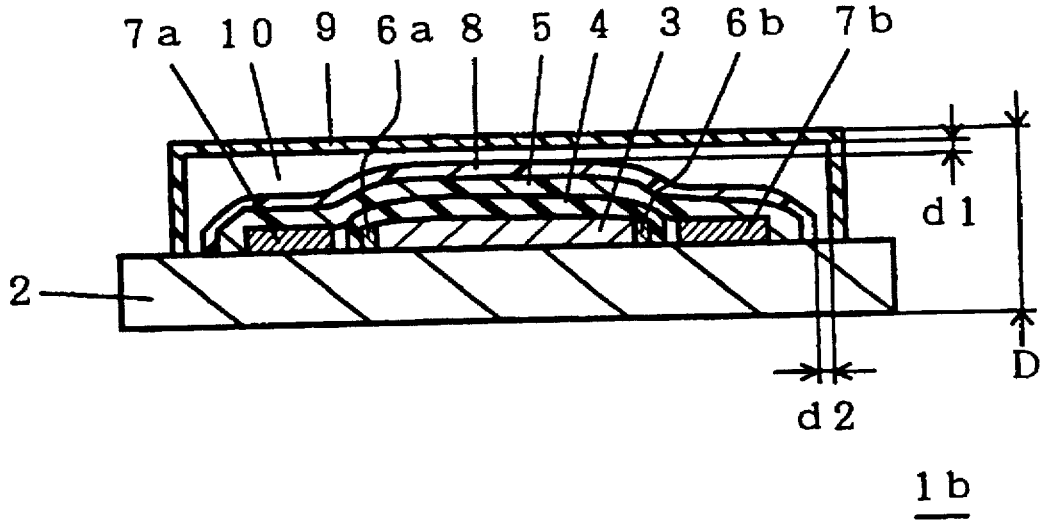

More specifically, FIGS. 2A and 2B are a plan view (FIG. 2A) and an X—X cross section (FIG. 2B), of a protective device 1*b* in which the low-melting metal piece 5 of the protective device 1*a* in FIG. 1 as described above is sealed with an inner sealing portion 8 which is formed of a material having a lower melting point or lower softening point than the low-melting metal piece 5 and its outer surface is further covered with an outside casing 9.

Once the surface of the low-melting metal piece 5 is oxidized, the oxidized surface thereof does not melt even when the low-melting metal piece 5 is heated to its inherent melting temperature, so that the low-melting metal piece 5 does not blow in some occasions. However, the sealing of the low-melting metal piece 5 with the inner sealing portion 8 can prevent the low-melting metal piece 5 from its surface oxidation, and hence makes it possible to surely cause the low-melting metal piece to blow when it is heated to a given temperature. Since also the inner sealing portion 8 is formed of a material having a lower melting point or lower softening point than the low-melting metal piece 5, the sealing of the low-melting metal piece 5 with this inner sealing portion 8 by no means hinders the low-melting metal piece 5 from blowing.

The inner sealing portion 8 may preferably be made to act not only to prevent the surface oxidation of the low-melting metal piece 5 but also to remove any metal oxide film formed on the surface. Hence, as sealing compounds used in the inner sealing portion 8, it is preferable to use sealing compounds capable of removing metal oxide films, as exemplified by organic acids and inorganic acids. In particular, a non-corrosive solid flux containing abletic acid as a main component is preferred. This is because the abletic acid is solid and inactive at room temperature, but melts upon heating to about 120° C. or above and turn active to exhibit the action to remove metal oxides, and hence it is possible not only to surely cause the low-melting metal piece to blow when it is heated to a given temperature but also to improve the storage stability of the protective device. As a method to form the inner sealing portion 8 by the use of the solid flux, it is preferable to melt the solid flux by heating without use of a solvent from the viewpoint of preventing craters, and coating the resulting molten product on the low-melting metal piece 5.

The inner sealing portion 8 may preferably have a thickness, depending on the type of the sealing compound, of approximately from 10 to 100 μm in usual instances, from the viewpoint of preventing surface oxidation of the low-melting metal piece 5 or from the viewpoint of the ability to remove surface oxide films.

The outside casing 9 is provided so that any molten product can be prevented from flowing out of the protective device when the low-melting metal piece 5 or inner sealing portion 8 melts. It is preferable for this outside casing 9 to be so provided as to leave a gap 10 between it and the inner sealing portion 8 as shown in FIG. 2B. In this instance, a size d1 of the gap in the vertical direction may preferably be set at approximately from 50 to 500 μm, and a size d2 in the horizontal direction, approximately from 0.2 to 1.0 mm. The gap 10 with such size assures the space in which the molten product can move when the low-melting metal piece 5 or inner sealing portion 8 melts, and hence makes it possible to surely cause the low-melting metal piece 5 to blow.

There are no particular limitations on materials for constituting the outside casing 9. From the viewpoint of taking the form of a housing having the space defined over the inner sealing portion 8 and from the viewpoint of thermal resistance and flame retardance, it is preferable to use nylon 4/6, liquid-crystal polymer or the like to which a flame-retardant has been added.

When the low-melting metal piece 5 is sealed with the inner sealing portion 8 and also the inner sealing portion 8 is covered with the outside casing 9 so as to leave the gap 10 between them, it is possible to ensure the reliability for the low-melting metal piece 5 to blow when heated to a given temperature and also to make the protective device have as a whole a thickness D of about 1 mm or less. Thus, such a protective device 1*b* can be a protective device good enough to meet the demand for making the protective device reliable in operation and smaller in size.

The constitution that the low-melting metal piece 5 is sealed with the inner sealing portion 8 and also the inner sealing portion 8 is covered with the outside casing 9 so as to leave the gap 10 between them is in itself applicable also to protective devices having no heating element 3. That is, while in the protective device 1*b* shown in FIGS. 2A and 2B the heating element 3 is provided so that it can have the intended function in an overvoltage protector as will be described layer, the above constitution is also applicable to conventional overcurrent-preventive chip type fuses not having such a heating element 3, where the low-melting metal piece may be sealed with such an inner sealing portion and also the inner sealing portion may be covered with such an outside casing so as to leave a gap between them. This is useful for making the protective device more reliable in operation and smaller in size, and this enables decrease the thickness of the chip type fuse by about 50% of conventional devices. Hence, the present invention also embraces an overcurrent-preventive protective device comprising a substrate, a low-melting metal piece provided on the substrate, an inner sealing portion which is formed of a material having a lower melting point or lower softening point than the low-melting metal piece and seals the low-melting metal piece, and an outside casing that covers the inner sealing portion, leaving a gap between the outside casing and the inner sealing portion (i.e., the second mode of the invention).

Figure 3A:
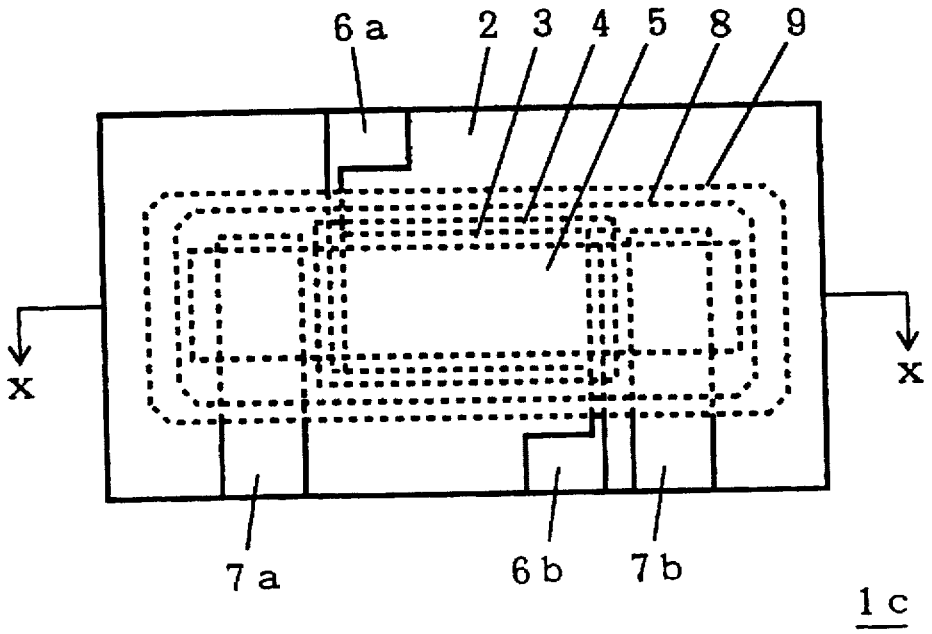
FIGS. 3A and 3B are a plan view and an X—X cross section, respectively, of a protective device according to still another embodiment of the present invention.
Figure 3B:
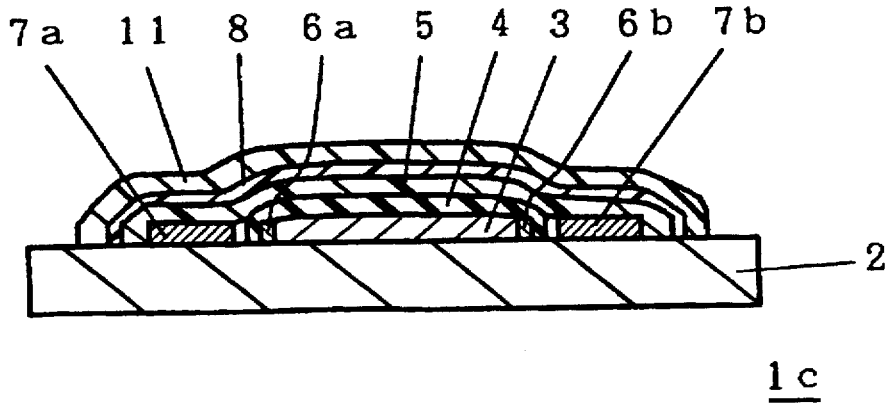

Meanwhile, FIGS. 3A and 3B are a plan view (FIG. 3A) and an X—X cross section (FIG. 3B), of a protective device 1*c* in which the outside casing 9 that covers the inner sealing portion 8 in the above protective device 1*b* shown in FIGS. 2A and 2B is replaced with an outer sealing portion 11 with which the inner sealing portion 8 is sealed. This outer sealing portion 11 is also provided so that any molten product can be prevented from flowing out of the protective device when the low-melting metal piece 5 or inner sealing portion 8 melts. Accordingly, as constituent materials therefor, those having a higher melting point or higher softening point than the low-melting metal piece 5 are used. For example, epoxy type sealing compounds or phenol type sealing compounds may be used.

In the protective device 1*b* previously shown in FIGS. 2A and 2B, it is enough for the inner sealing portion 8 to have a thickness of approximately from 10 to 100 μm in usual instances, from the viewpoint of preventing surface oxidation of the low-melting metal piece 5 or from the viewpoint of the ability to remove surface oxide films. In the case of the protective device 1*c* shown in FIGS. 3A and 3B, it becomes possible for the low-melting metal piece 5 to blow on account of the melt flow within the region where the inner sealing portion 8 is formed. Accordingly, the inner sealing portion 8 may preferably have a thickness of approximately from 500 to 1,500 μm from the viewpoint of causing the low-melting metal piece 5 to surely blow.

Figure 4:
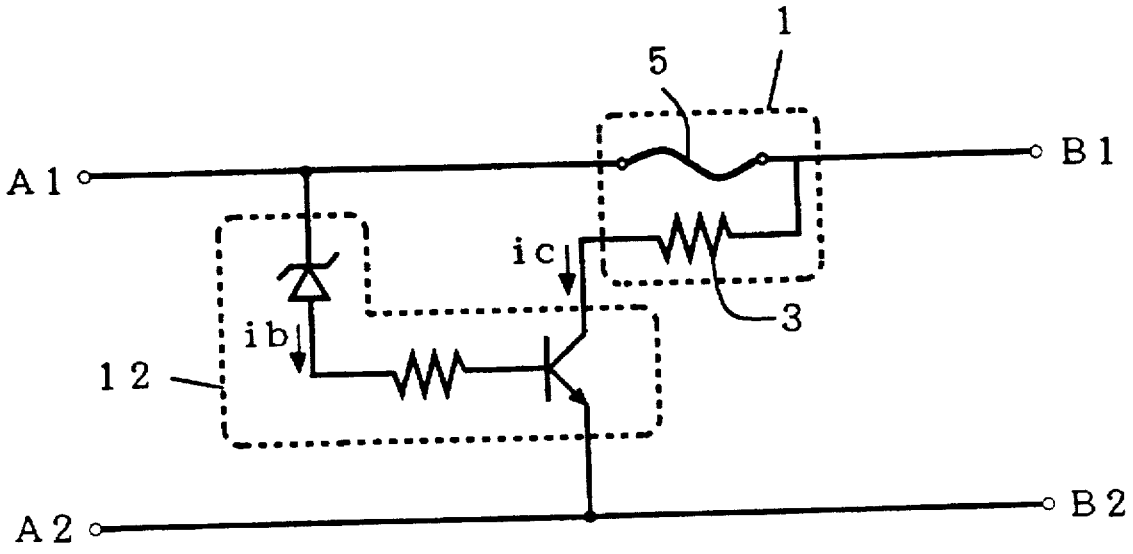
FIG. 4 is a circuit diagram of an overvoltage protector making use of the protective device of the present invention.

The protective devices 1 (1*a*, 1*b* and 1*c*) shown in FIGS. 1A and 1B to FIGS. 3A and 3B can each be used in combination with a voltage detecting means 12 comprised of a zener diode and a transistor, to set up a overvoltage protector as shown by a circuit diagram in FIG. 4. In the circuit shown in FIG. 4, terminals A1 and A2 are connected with electrode terminals of a unit to be protected, e.g., a lithium ion cell, and terminals B1 and B2 are connected with electrode terminals of a unit such as a charger which, when used, is connected with the unit to be protected. According to this circuit construction, a base current ib abruptly flows when the charging of the lithium ion cell proceeds until a reverse voltage exceeding the breakdown voltage is applied to the zener diode of the voltage detecting means 12, whereupon a great collector current ic flows through the heating element 3 to electrically excite it, and the heating element 3 generates heat to cause the low-melting metal piece 5 on the heating element to blow, so that the overvoltage can be prevented from being applied across the terminals A1 and A2. Thus, the present invention also embraces an overvoltage protector comprising the above protective device 1 of the present invention and the voltage detecting means 12; the heating element of the protective device being electrically excited through the voltage detecting means to generate heat.

In the foregoing, the protective device and overvoltage protector of the present invention have been described in detail. Besides the above embodiments, the protective device and overvoltage protector of the present invention may have other various embodiments.

Figure 5A:
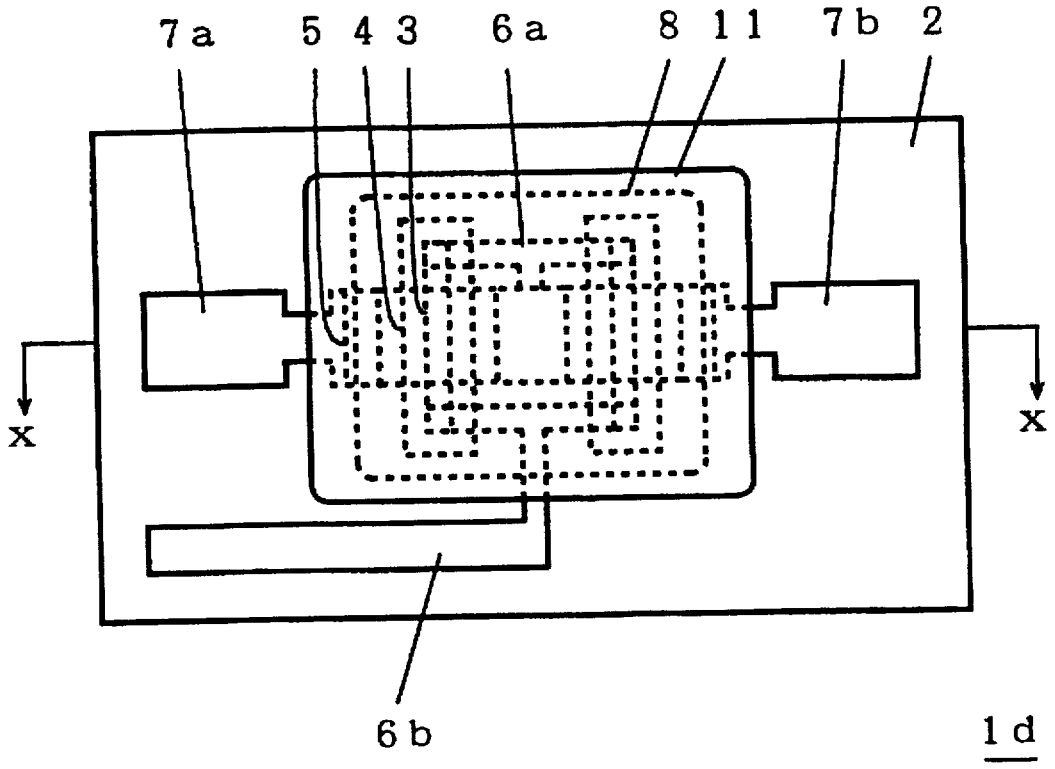
FIGS. 5A and 5B are a plan view and an X—X cross section, respectively, of a protective device according to still another embodiment of the present invention.
Figure 5B:
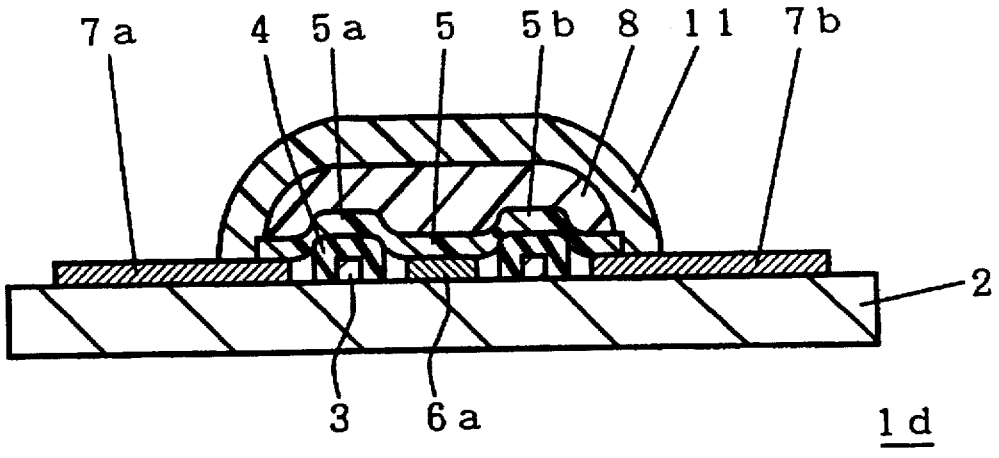
Figure 6:
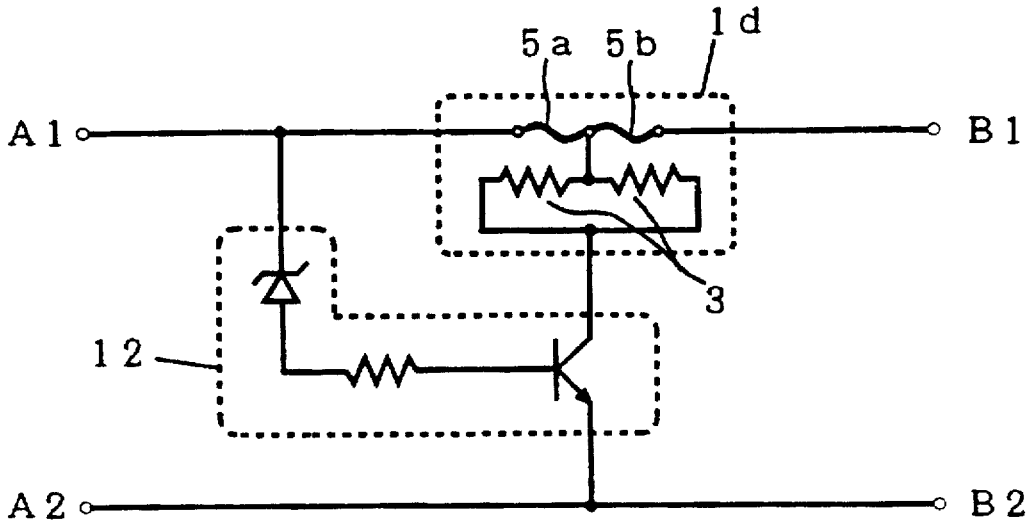
FIG. 6 is a circuit diagram of an overvoltage protector according to another embodiment, making use of the protective device of the present invention.

For example, FIGS. 5A and 5B are a plan view (FIG. 5A) and an X—X cross section (FIG. 5B), of a protective device 1*d* in which the planar patterns of the heating element 3 and low-melting metal piece 5 of the protective device shown in FIG. 1 were so changed that the low-melting metal piece 5 may blow at two points 5*a* and 5*b* upon heating. FIG. 6 is a circuit diagram of an overvoltage protector constituted using the protective device 1*d*.

In the circuit construction shown in FIG. 4 as previous described, where the terminals A1 and A2 are connected with electrode terminals of a lithium ion cell and the terminals B1 and B2 are connected with electrode terminals of a charger, the heating element 3 is still kept electrically excited even after the low-melting metal piece 5 of the protective device 1 has blown because of overcharging. In contrast, according to the circuit construction shown in FIG. 6, the heating element 3 is completely stopped from electrical excitation after the low-melting metal piece 5 has blown at the two points 5*a* and 5*b*. Thus, it becomes possible to more improve the safety required for overvoltage protectors.

As described above, the protective device of the present invention comprises a substrate (particularly preferably an inorganic substrate), a heating element (particularly preferably a heating element formed of an inorganic material) provided on the substrate, an insulating layer that covers the surface of the heating element, and a low-melting metal piece provided on the insulating layer. Thus, the use of this protective device in combination with a voltage detecting means makes it possible to set up a overvoltage protector. More specifically, upon detection of an overvoltage by the voltage detecting means, the heating element of the protective device generates heat to cause the low-melting metal piece provided thereon, to blow.

EXAMPLES

Example 1

Example (1—1)

An evaluation protective device (with an inorganic type heating element), like the one shown in FIGS. 1A and 1B, was produced in the following way.

First, as an inorganic substrate, an alumina-based ceramic (thickness: 0.5 mm) was prepared, and a silver paste (QS174, available from Du Pont de Nemours, E.I., Co.) was coated by screen printing in a terminal pattern as shown in FIG. 1, followed by baking at 870° C. for 30 minutes to form heating element terminals 6*a* and 6*b* and low-melting metal piece terminals 7*a* and 7*b*. Next, between the heating element terminals 6*a* and 6*b*, a ruthenium oxide resistive paste (DP1900, available from Du Pont de Nemours, E.I., Co.) was coated by screen printing, followed by baking at 870° C. for 30 minutes to form a heating element 3 with a resistance of 10 Ω. Then, a silica resistive paste (AP5346, available from Du Pont de Nemours, E.I., Co.) was printed on the heating element so as not to cover the low-melting metal piece terminals 7*a* and 7*b*, followed by baking at 500° C. for 30 minutes to form an insulating layer 4. Next, onto the heating element terminals 6*a* and 6*b*, a low-melting metal foil (Sn:Sb=95:5; liquid-phase point: 240° C.) of 1 mm×4 mm was bonded by hot pressing to form a low-melting metal piece 5. Thus, the evaluation protective device (with an inorganic type heating element) of the present invention was produced.

Example (1-2)

The procedure of Example (1—1) was repeated to produce an evaluation protective device comprising an organic type heating element, except that the heating element 3 was formed using a phenol type carbon paste (FC-403R, available from Fujikura Kasei Co., Ltd.) and the insulating layer 4 was formed using an epoxy resistive paste.

Evaluation

To test each of the evaluation protective device of Example (1—1) (with an inorganic type heating element) and the evaluation protective device of Example (1-2) (with an organic type heating element), a voltage of 4 V was applied across the heating element terminals *6a* and *6b*, where changes with time in electric currents and the time by which the low-melting metal piece 5 blew were measured and also how it blew was visually observed.

Figure 7:
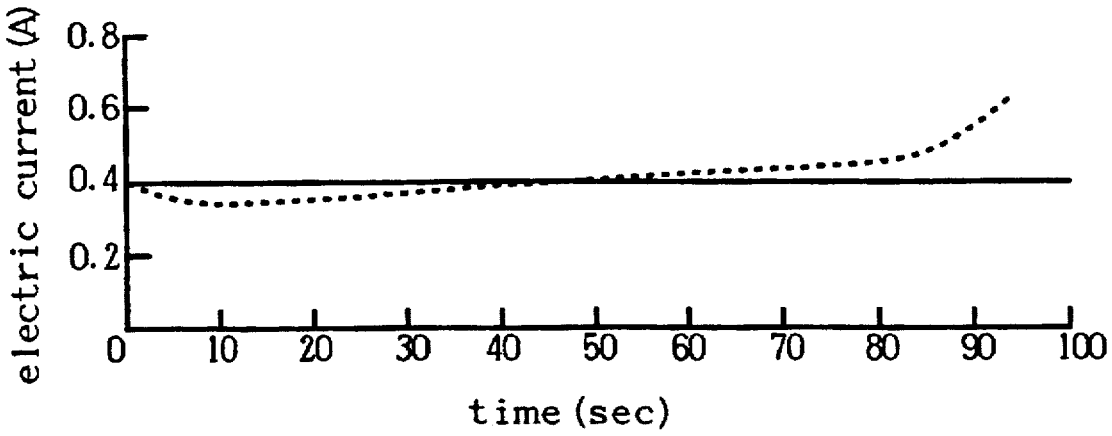
FIG. 7 is a graph to show changes with time in electric currents when a voltage is applied to a heating element of the protective device according to Examples.

The changes with time in electric currents, thus measured, are shown in FIG. 7. As is seen from FIG. 7, the heating element of Example (1—1), as indicated by a solid line in FIG. 7, shows always stable electric current values, and proves to cause no change in its resistance. On the other hand, the heating element of Example (1-2), as indicated by a dotted line in FIG. 7, shows an increase in electric current values which begins in about 15 seconds after start of electrical excitation, and proves to have caused a decrease in resistance. As is also seen therefrom, the heating element of Example (1-2) shows an abrupt increase in electric current values in about 80 seconds after start of electrical excitation.

In the protective device of Example (1—1), the time by which the low-melting metal piece 5 blew was 21 seconds, and no particular changes were seen throughout in appearance of the heating element. On the other hand, in the protective device of Example (1-2), the time by which the low-melting metal piece 5 blew was 19 seconds, and the heating element caught fire in about 93 seconds after start of electrical excitation.

From the above results, it has been confirmed that these devices are useful as protective devices since the low-melting metal piece blows whichever material the heating element is formed of, the organic material or the inorganic material, and a protective device promising a higher safety can be obtained especially when the heating element is formed of the inorganic material.

Example 2

To produce a protective device according to the embodiment as shown in FIGS. 2A and 2B, the procedure in Example (1—1) was followed except that on the low-melting metal piece 5 of the protective device a pasty flux (HA 78 TS-M, available from Tarutin Co., Ltd.) was coated in a thickness of about 0.5 mm to form an inner sealing portion 8 and then an outside casing 9 obtained by molding a liquid-crystal polymer (G-530, available from Nippon Petrochemicals Co., Ltd.) was bonded with an epoxy adhesive.

Example 3

To produce a protective device according to the embodiment as shown in FIGS. 3A and 3B, the procedure in Example (1—1) was followed except that on the low-melting metal piece 5 of the protective device a solid flux (Flux K201, available from Tarutin Co., Ltd.) was applied by means of a dispenser applicator heated to 140° C., followed by treatment in an oven with 100° C. internal air circulation so as for the flux applied to uniformly spread on the low-melting metal piece 5, to form an inner sealing portion 8. The flux thus coated was in a thickness of about 0.8 mm. On the resulting inner sealing portion 8, a two-pack mixture type epoxy resin was coated so as to cover the whole surface thereof, followed by curing at 40° C. for 16 hours to form an outer sealing portion 11.

Evaluation

To test each of the protective devices of Examples 2 and 3, a digital multimeter was connected to the low-melting metal piece terminals *7a* and *7b* and a voltage of 4 V was applied across the heating element terminals *6a* and *6b* while watching the resistance. As a result, it was ascertained that in both the protective devices the low-melting metal pieces 5 blew in 60 seconds. Here, no low-melting metal piece was seen to flow out of the outside casing 9 or the outer sealing portion 11.

The respective protective devices were also kept in an environment of 60° C./95%RH or 105° C. for 250 hours and thereafter tested by applying voltage in the same manner as the above. In this test also, the same results as in the voltage application test initially made were obtained.

Example 4

Example (4-1)

Production of Protective Device

Figure 8A:
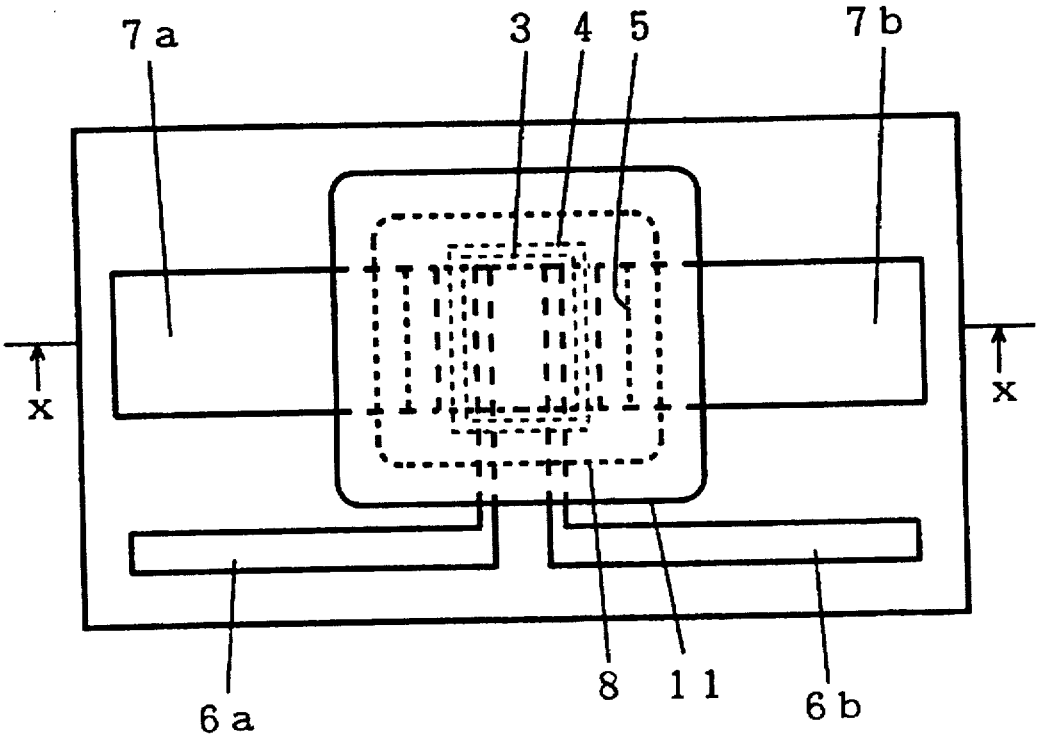
FIGS. 8A and 8B are a plan view and an X—X cross section, respectively, of a protective device of the present invention.
Figure 8B:
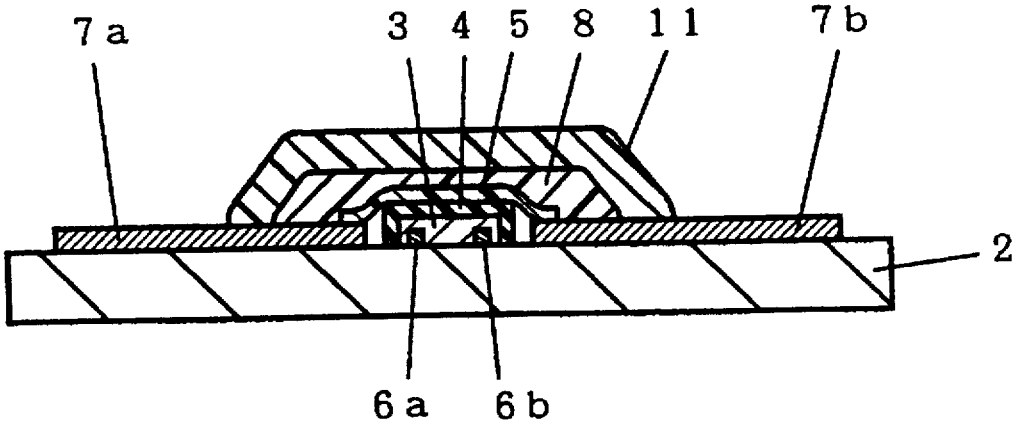

A protective device *1e* with the plan view and X—X cross section as shown in FIGS. 8A and 8B was produced in the following way.

Figure 9:
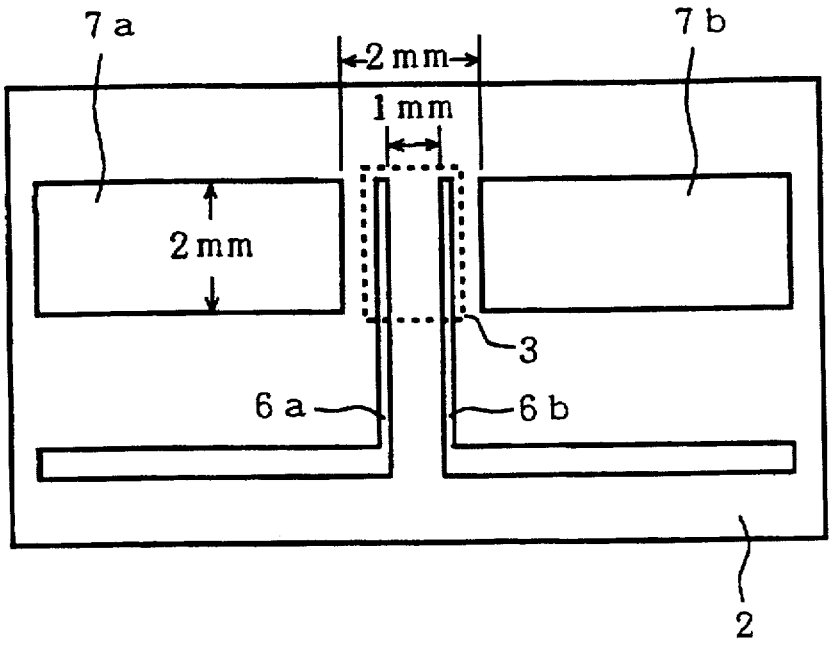
FIG. 9 is a plan view of a conductor pattern used in the protective device of the present invention.

First, on a glass epoxy substrate of 0.2 mm thick, a pattern as shown in FIG. 9 was formed by etching, and a phenol type carbon paste (FC-403R, available from Fujikura Kasei Co., Ltd.) was applied between heating element terminals *6a* and *6b* by screen printing, followed by curing at 150° C. for 30 minutes to form a heating element 3. The heating element thus formed was in a size of 1.4 mm×2 mm and a thickness of 20 μm. The resistance between the terminals *6a* and *6b* was 4.5 Ω.

Next, on the heating element 3, an epoxy type insulating paste was coated by screen printing so as to cover the whole surface of the heating element but not to extend over the low-melting metal piece terminals *7a* and *7b*, followed by curing at 150° C. for 30 minutes to form an insulating layer 4. The insulating layer 4 thus formed was in a size of 2.4 mm×1.6 mm and a thickness of 25 μm. The epoxy type insulating paste used here had the formulation as shown below.

(By Weight)

YDF-170 (available from Toto Chemical Co., Ltd.)

100 parts

Alumina powder A-42-6 (available from Showa Denko K.K.)

200 parts

Dicyandiamide (available from ACI Japan Ltd.) 7.4 parts

PN-23 (available from Ajinomoto Co., Inc.) 3.0 parts

The above components were premixed and thereafter dispersed by means of a three-roll mill.

Next, across the low-melting metal piece terminals 7a and 7b, a low-melting metal piece 5 of 2 mm×6 mm and 100 μm thick was connected by hot pressing. The hot pressing was carried out under conditions of 145° C., 5 kgf/cm$^2$ and 5 seconds while interposing a 25 μm thick polyimide film between the low-melting metal piece 5 and the press head. This can prevent the low-melting metal piece 5 from melting during the hot pressing. The low-melting metal piece 5 used here had the composition of Pb:Bi:Sn 43.0:28.5:28.5.

To seal the low-melting metal piece 5 of the device thus obtained, first 10 mg of a rosin flux HA-78 TS-M (available from Tarutin Co., Ltd.; melting point: 85° C.) was coated, followed by drying at 100° C. for 30 minutes to form an inner sealing portion 8. Then, 20 mg of a two-pack epoxy type sealing compound was coated thereon, followed by curing at 60° C. for 1 hour to form an outer sealing portion 11. Thus, the protective device as shown in FIGS. 8A and 8B was obtained.

The epoxy type sealing compound (comprised of a base material and a curing agent) used here had the formulation as shown below.

Base Materials (By Weight)

YH-315 (available from Toro Chemical Co., Ltd.)

100 parts

HAKUENKA CCR (available from Shiraishi Calcium Kaisha, Ltd. 20 parts

TSA-720 (available from Toshiba Silicone Co., Ltd.)

0.1 part

Phthalocyanine blue 0.1 part

The above components were premixed and thereafter dispersed by means of a three-roll mill.

Curing Agent

XL-1 (available from Yuka Shell Epoxy Kabushikikaisha)

Base materials: curing agent - 100:30 (weight ratio)

Evaluation

The protective device thus obtained was tested on the following items.

Low-melting Metal Piece Resistance

Measured using a digital multimeter R6871E (manufactured by Advantest)

Heating Element Resistance

Ditto.

Heating element calorific value at low-melting metal piece blow:

An electric current was passed through the heating element, using a DC power source 6033A (manufactured by YHP), and the heating element calorific value at the time the low-melting metal piece had blown was calculated according to the expression: $I^2R$.

Break Current

An electric current was passed through the low-melting metal piece at a rate of 0.1 A/second, using a DC power source 6033A (manufactured by YHP), and the value at the break of the current was read.

Aging Test

The device was put in a thermo-hygrostatic oven of 60° C./90%RH, and the characteristics after 500 hours were measured on the above items.

Test results obtained were as shown below.

Initial Values

Low-melting metal piece resistance: 12 mΩ

Heating element resistance: 4.5 Ω

Heating element calorific value at low-melting metal piece blow: 750 mW

Break current: 5.5 A

Values after 60° C.×90%RH×500 hr

Low-melting metal piece resistance: 12 mΩ

Heating element resistance: 4.6 Ω

Heating element calorific value at low-melting metal piece blow: 760 mW

Break current: 5.5 A

Example (4-2)

Production of Overvoltage-preventive Protective Device

The protective device of Example (4-1) is a device in which as described above an electric current fuse (the low-melting metal piece) which breaks the current at 5.5 A is thermally brought into contact with the heating element which causes the low-melting metal to blow when the heating element is electrically excited and it generates heat. This device was set in combination with a voltage detecting device in the circuit as shown in FIG. 4 to obtain a overvoltage protector. In the circuit construction shown in FIG. 4, where the protective device of Example (4-1) was used, a current flowed through the heating element when the voltage across the terminals A1 and A2 exceeds 4.5 V (the breakdown voltage of the zener diode), to cause its low-melting metal piece to blow.

As is seen from the foregoing, according to the present Example, it is possible to cause the low-melting metal piece 5 to blow under any desired conditions when the circuit is so constructed that the current flows through the heating element of the protective device under certain conditions, and hence the device can be applied as a protective device for various purposes such as voltage detection, optical detection, temperature detection and sweating detection.

Example 5

Example (5-1)

Production of Protective Device

A protective device as shown in FIGS. 5A and 5B was produced in the following way.

Figure 10:
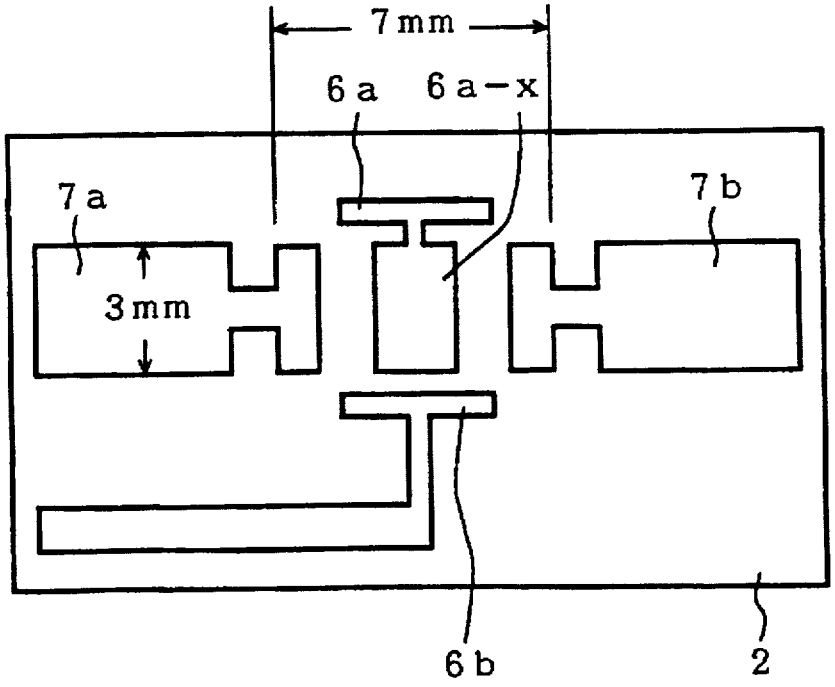
FIG. 10 is a plan view of another conductor pattern used in the protective device of the present invention.

First, on a polyimide film of 25 μm thick, a conductor pattern as shown in FIG. 10 was formed, and a phenol type carbon paste (FC-403R, available from Fujikura Kasei Co., Ltd.) was applied between heating element terminals 6a and 6b by screen printing so as not to extend over the low-melting metal piece terminals 7a and 7b and an end 6a–x of the heating element terminal 6a (FIG. 10), followed by curing at 150° C. for 30 minutes to form a heating element 3.

Next, on the heating element 3, an insulating paste was coated by screen printing so as to cover the whole surface of the heating element formed of the carbon paste, but not to extend over the low-melting metal piece terminals 7a and 7b and the end 6a–x of the heating element terminal 6a, followed by curing at 150° C. for 30 minutes to form an insulating layer 4. The insulating paste used here to form the insulating layer 4 had the same formulation as in Example 1.

Next, across the low-melting metal piece terminals 7a and 7b, a low-melting metal piece 5 (5a, 5b) of 7 mm×3 mm and 100 μm thick was connected by hot pressing. The hot pressing was carried out under conditions of 145° C., 5 kgf/cm$^2$ and 5 seconds while interposing a 25 μm thick polyimide film between the low-melting metal piece 5 and the press head. This can prevent the low-melting metal piece 5 from melting during the hot pressing. The low-melting metal piece 5 used here was the same as the one used in Example 4.

To seal the low-melting metal piece 5 of the device thus obtained, first 10 mg of a rosin flux HA-78 TS-M (available from Tarutin Co., Ltd.; melting point: 85° C.) was coated, followed by drying at 100° C. for 30 minutes to form an inner sealing portion 8. Then, 20 mg of a two-pack epoxy type sealing compound was coated thereon, followed by curing at 80° C. for 30 minutes to form an outer sealing portion 11. Thus, the protective device as shown in FIGS. 5A and 5B was obtained.

The epoxy type sealing compound (comprised of a base material and a curing agent) used here had the formulation as shown below. The epoxy type sealing compound by no means melts at the melting point (137° C.) of the low-melting metal piece 5.

Base materials (By Weight)

YH-315 (available from Toto Chemical Co., Ltd.)

100 parts

HAKUENKA CCR (available from Shiraishi Calcium Kaisha, Ltd.) 20 parts

TSA-720 (available from Toshiba Silicone Co., Ltd.)

0.1 part

DISPARON (available from Kusumoto Chemicals Ltd.)

0.1 part

The above components were premixed and thereafter dispersed by means of a three-roll mill.

Curing Agent

XL-1 (available from Yuka Shell Epoxy Kabushikikaisha)

Base materials: curing agent=100:30 (weight ratio)

Evaluation

The protective device thus obtained was tested on the following items.

Low-melting Metal Piece Resistance

Measured using a digital multimeter R6871E (manufactured by Advantest)

Heating Element Resistance

The resistance between the heating element terminals 6a and 6b shown in FIGS. 5A and 5B was measured in the same manner as the above.

Figure 11:
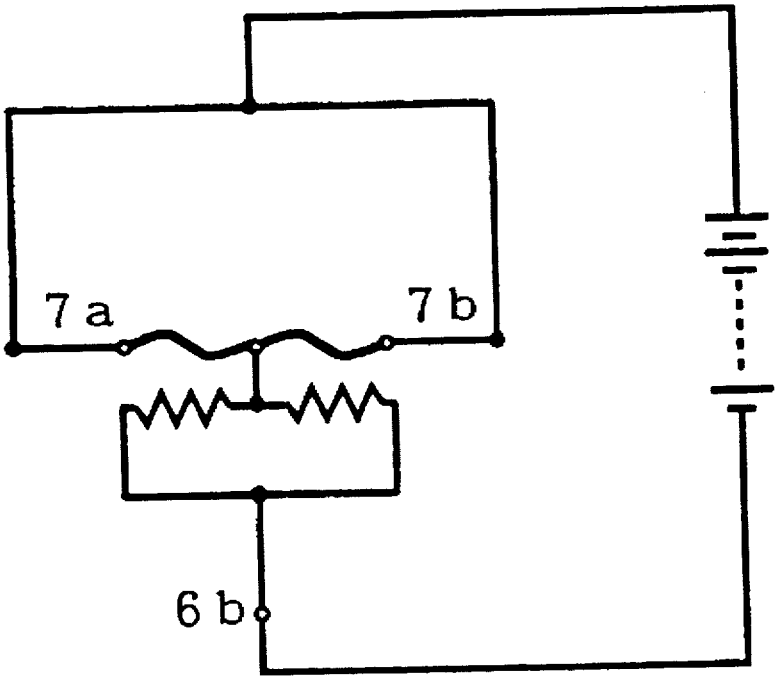
FIG. 11 is a circuit diagram used when the calorific value of a heating element at the blow of a low-melting metal piece is measured.

Heating element calorific value at low-melting metal piece blow:

Lead wires were extended from the low-melting metal piece terminals 7a and 7b shown in FIGS. 5A and 5B and connected together. This was connected to a DC power source 6033A (manufactured by YHP) to make up a circuit as shown in FIG. 11, and the heating element calorific value at the time the low-melting metal piece had blown was calculated according to the expression: $I^2R$.

Break Current

An electric current was passed through the low-melting metal piece 5 at a rate of 0.1 A/second, and the value at the break of the current was read.

Aging Test

The device was put in a thermo-hygrostatic oven of 60° C./90%RH, and the characteristics after 500 hours were measured on the above items.

Test results obtained were as shown below.

Initial Values

Low-melting metal piece resistance: 13 mΩ

Heating element resistance: 21 Ω

Heating element calorific value at low-melting metal piece blow: 710 mW

Break current: 6.2 A

Values After 60° C.×90%RH×500 hr

Low-melting metal piece resistance: 13 mΩ

Heating element resistance: 22 Ω

Heating element calorific value at low-melting metal piece blow: 710 mW

Break current: 6.2 A

Example (5-2):

Production of Overvoltage-preventive Protective Device

The protective device of Example (5-1) shown above was set in combination with a voltage detecting device to obtain an overvoltage protector as shown in FIG. 6. When electricity was applied from either side of the low-melting metal piece terminals 7a and 7b shown in FIGS. 5A and 5B, the low-melting metal piece 5 (5a, 5b) blew to stop the electrical excitation to the heating element, proving to be safe. Thus, it was confirmed that the device is useful as an overvoltage protector of cells.

Example 6

To examine the materials for the inner sealing portion formed on the low-melting metal piece, evaluation samples were prepared using materials shown in Table 2, as materials used on the low-melting metal piece 5 in the protective device of Example 5, having the structure shown in FIGS. 5A and 5B.

TABLE 2

| Example: | Inner-sealing compound | Main component | Metal oxide removal action |
|---|---|---|---|
| 6-1 | X-201 (available from Tarutin Co., Ltd.) | Abietic acid | Yes |
| 6-2 | * (available from Applicant Company) | Zinc chloride | Yes |
| 6-3 | KE1830 (available from Shin-Etsu Silicon Co., Ltd.) | Silicone oil | No |
| 6-4 | 100P (available from Mitsui Petrochemical Industries, Ltd.) | Polyethylene | No |

*composed of: zinc chloride, 25 parts by weight; ammonium chloride, 3.5 parts by weight; water, 6.5 parts by weight; and vaseline, 65 parts by weight.

In the samples obtained in the above, setting the low-melting metal piece terminals 7a and 7b to serve as the positive pole and the heating element terminal 6b as the negative pole, a voltage was applied from a constant-voltage power source (6033A, manufactured by YHP) so as for the heating element 3 to have a calorific value of 1 W (see FIG. 11). Then, the time by which the low-melting metal piece 5 blew was measured. Results of measurement were as shown in Table 3.

TABLE 3

| | Example | | | |
|---|---|---|---|---|
| Main component: | 6-1 Abietic acid | 6-2 Zinc chloride | 6-3 Silicone oil | 6-4 Poly-ethylene |
| Blow time: (sec) | | | | |
| Sample No. 1 | 9 | 10 | 35 | Not blow |
| Sample No. 2 | 10 | 9 | Not blow | Not blow |
| Sample No. 3 | 10 | 8 | Not blow | 40 |
| Sample No. 4 | 9 | 9 | 20 | Not blow |
| Sample No. 5 | 10 | 9 | Not blow | Not blow |

As is seen from the table, satisfactory results that the blow time is 9 to 10 seconds are obtained when the inner-sealing compound mainly composed of abletic acid is used, since the abletic acid has the action to remove metal oxides.

Similarly, satisfactory results that the blow time is 8 to 10 seconds are also obtained in Example 6-2, i.e., when the inner-sealing compound mainly composed of zinc oxide is used, since the zinc oxide has the action to remove metal oxides.

On the other hand, under the stated test conditions, the low-melting metal piece 5 does not blow or, if blows, takes a time as long as 20 to 35 seconds in Example 6-3, i.e., when the inner-sealing compound mainly composed of silicone oil is used, since the silicone has no action to remove metal oxides.

Similarly, under the stated test conditions, the low-melting metal piece 5 does not blow or, if blows, takes a time as long as 40 seconds in Example 6-4, i.e., when the inner-sealing compound mainly composed of a polyethylene wax is used, since the polyethylene wax has no action to remove metal oxides.

From the above results, it has been confirmed that, according to the present Examples, the heating element can be surely operated during electrical excitation when the material having the action to remove metal oxides is used in the inner sealing portion 8 formed on the low-melting metal piece 5.

Example 7

To examine the advantages obtained when the inner sealing portion is formed using a solid flux not by dissolving the solid flux in a solvent but by heating and melting the solid flux alone, protective devices were produced in the following way.

Example (7-1)

A protective device was produced in the same manner as in Example 4 except that when the inner sealing portion was formed, a solid flux (FLUX-K201, available from Tarutin Co., Ltd.; softening point: 86° C.) was heated to 140° C. and applied onto the low-melting metal piece 5, using a hot dispenser system (AD 2000, TCD200, manufactured by Iwashita Engineering) to form a coating.

This coating was heated at 100° C. for 2 minutes until it became fitted to the low-melting metal piece 5, and thereafter its outside was sealed with a two-pack epoxy resin by curing at 80° C. for 30 minutes. Thus, samples were obtained.

To the heating element of each sample, a voltage was applied so as to provide a calorific value of 800 mW. As a result, the fuse blew in 5 to 12 seconds (average: 8.2 seconds; the number of samples, n=5).

Example (7-2)

The same solid flux (FLUX-K201) as the one used in Example (7-1) was dissolved in ethanol and made pasty so as to be in a solid content of 50%. The pasty product obtained was coated on the low-melting metal piece 5, followed by drying at a high temperature of 80° C. for 5 minutes. As a result, craters and bubbles occurred.

Samples were prepared in the number n=5, and the same procedure was repeated. As a result, two samples among the five samples took a time of 1 minute or longer until the low-melting metal piece blew (blow time: 5 to 95 seconds; average: 39.2 seconds)

Example (7-3)

In the same manner as in Example (7-2), a pasty product of the solid flux was coated, followed by drying at a lower temperature of 60° C. for 1 hour, and thereafter, its outside was sealed with a two-pack epoxy type sealing compound by curing at 80° C. for 30 minutes. As a result, craters occurred because of the solvent remaining in the solid flux.

Example (7-4)

In the same manner as in Example (7-2), a pasty product of the solid flux was coated, followed by first drying at 60° C. for 1 hour and thereafter further continuous drying at 80° C. for 5 minutes. As a result, craters and bubbles occurred, giving the same results as in Example (7-2).

From the above results, it has been confirmed that, according to the present Examples, the solid flux used to form the inner sealing portion is not dissolved in the solvent but heated and melted using the solid flux alone, whereby the stable solid flux can be applied onto the low-melting metal piece 5 and hence the characteristics can be very stable.

Example 8

To examine how it can be effective on the state of sealing if the outer sealing portion is formed using the outer-sealing compound by coating under control of its viscosity, protective devices were produced in the following way.

In Example 4, previously described, the two-pack epoxy type sealing compound was used as the outer-sealing compound, which was coated on the inner sealing portion, followed by heating at 60° C. for 1 hour to effect curing.

In such a case, when the outer-sealing compound is coated on the inner sealing portion, the outer-sealing compound may flow away over the inner sealing portion and can not well cover the inner sealing portion if the outer-sealing compound has an excessively low viscosity.

If on the other hand the outer-sealing compound has an excessively high viscosity, its fluidity may become poor to produce holes in the outer sealing portion or make the surface of the outer sealing portion higher, resulting in the loss of the advantage attributable to small-sized parts. There have been such problems.

Now, the present Examples, Examples (8-1) to (8-7), are presented to examine how it can be effective on the state of sealing if protective devices are produced in the same manner as in Example 4 except that the outer-sealing compound is coated under control of its viscosity.

The outer-sealing compound (comprised of a base material and a curing agent) used in the present Examples (8-1) to (8-7) has the composition as shown below. The amount of the filler is indicated as X parts by weight. The value thereof was changed to control the viscosity to obtain outer-sealing compounds of Examples (8-1) to (8-7).

Base Materials (By Weight)

YH-315 (available from Toto Chemical Co., Ltd.)

80 parts

HAKUENKA CCR (available from Shiraishi Calcium Kaisha, Ltd.) X parts

DISPARON (available from Kusumoto Chemicals Ltd.)

0.1 part

TSA-720 (available from Toshiba Silicone Co., Ltd.)

0.1 part

KETBlue 102 (available from DIC) 0.5 part

Curing Agents

EPOMATE LX1N (available from Toto Chemical Co., Ltd.)

50 parts

EPOMATE N001 (available from Toto Chemical Co., Ltd.)

50 parts

Base materials: curing agents=10:3 (weight ratio)

With regard to the viscosity of each outer-sealing compound, the base materials and curing agents shown above were mixed and immediately thereafter the viscosity of each mixture was measured using a Haake viscometer (rotor: PK-1, 1 degree; shear rate: 50 l/s).

The mixtures whose viscosity was controlled by changing the amount of the filler were each coated using a dispenser applicator by ejecting the mixture so as to cover the whole inner sealing portion, followed by heating at 80° C. for 30 minutes to effect sealing.

The state of sealing was examined by checking the appearance of the outer sealing portion thereby formed. Results obtained were as shown in Table 4.

TABLE 4

| | Example | | | | | | |
|---|---|---|---|---|---|---|---|
| | 8-1 | 8-2 | 8-3 | 8-4 | 8-5 | 8-6 | 8-7 |
| Amount X of filler: | | | | | | | |
| (pbw) | 5 | 10 | 15 | 20 | 25 | 30 | 35 |
| Viscosity: (Pa.s) | 0.5 | 0.8 | 1.3 | 1.8 | 3.1 | 5.5 | 11.0 |
| Seal appearance: | B | A | A | A | A | B | B |

A: Good, B: Poor

As is seen from the table, the viscosity is 0.5 Pa.s when the filler is in an amount of 5 parts by weight. In this case, because of an excessively low viscosity, the outer-sealing compound flowed away over the inner sealing portion, and could not achieve the object as the outer-sealing compound.

The viscosity is in the range of from 5.5 to 11.0 Pa.s when the filler is in an amount of 30 to 35 parts by weight. In this case, because of an excessively high viscosity, the outer-sealing compound did not evenly flow over the surface of the inner sealing portion to cause irregularities. In addition, since the outer-sealing compound did not flow, there was a difficulty that the outer sealing portion was fairly large in height unless it was leveled with the hand.

On the other hand, the viscosity is in the range of from 0.8 to 3.10 Pa.s when the filler is in an amount of 10 to 25 parts by weight. In this case, because of an optimum viscosity, it was possible to kneatly seal the inner sealing portion, and there occurred neither the flowing away of the outer-sealing compound over the inner sealing portion nor the irregularities on the outer sealing portion.

From the foregoing, it has been confirmed that, according to the present Examples, the inner sealing portion can be completely sealed and also protective devices free of any surface irregularities of the outer sealing portion can be obtained, when the viscosity of the outer-sealing compound at the time of coating is controlled within the stated range.

Example 9

In the present Example, to examine how it can be effective to form the protective device directly on a motherboard, protective devices were produced in the following way.

In all Examples previously set out, the protective devices are produced as devices. In practice, the step of mounting the device on a motherboard is required. Thus, in the case when, for example, the low-melting metal piece has a melting point lower than the heating temperature at the time of packaging, it is necessary to previously package other parts on the motherboard by reflowing and thereafter mount the device by manual soldering or the like. Accordingly, in the present Example, the protective device having the heating element was fabricated directly on the motherboard 15 (a flexible printed-wiring board).

Figure 12:
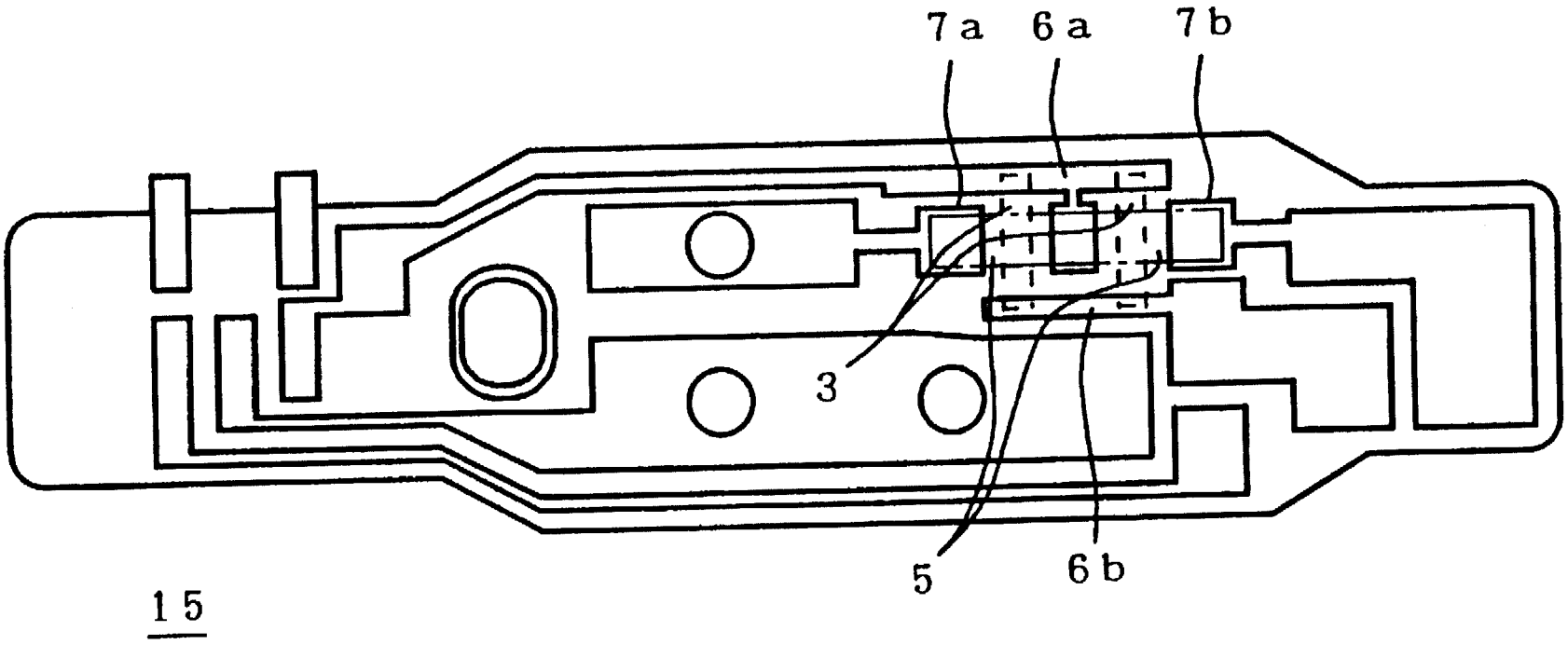
FIG. 12 is a plan view of a protective device provided on a flexible printed-wiring board.

First, a conductor pattern was formed on a flexible printed-wiring board (see FIG. 12) so as to provide the circuit construction as shown in FIG. 6. Next, a carbon paste (FC-403R, available from Fujikura Kasei Co., Ltd.) was printed by screen printing, at the position between the heating element terminals **6*a* and 6*b* where the heating element was to be formed. Thus, a parallel heating element (a resistor) 3 of 12 ohms was provided. Then, on this heating element 3**, an epoxy one-pack curable resin was printed by the same process to form an insulating layer (not shown). Next, a solder paste was applied to the lands of the portions where other parts were to be packaged, and the parts were mounted, followed by soldering in a reflowing furnace (not shown).

Subsequently, across the low-melting metal piece terminals **7*a* and 7*b* on the substrate, a low-melting metal foil 5 (available from Nippon Seihaku K.K.; Pb:Sn:Bi=43:28.5:28.5) was melt-bonded by hot pressing. Then a solid flux was applied onto the metal foil 5**, and further its surface was sealed with an epoxy resin.

On the substrate thus obtained, setting the low-melting metal piece terminals **7*a* and 7*b* to serve as the positive pole and the heating element terminal 6*b*** as the negative pole, a voltage of 3V was applied across the positive pole and the negative pole. The voltage was gradually increased, whereupon at a voltage of 4.5 V the heating element of the protective device generated heat to cause the low-melting metal foil to blow.

From the foregoing, it has been confirmed that the direct formation of the protective device on the motherboard can save trouble in packaging, can simplify the fabrication process and also can decrease the production cost.

As a matter of course, the present invention is by no means limited to the above Examples and can have other various embodiments so long as they do not deviate from the purport of the invention.

As described above, the protective device according to the first mode of the present invention makes it possible to cause the low-melting metal piece to blow under any desired conditions when the circuit is so constructed that the current flows through the heating element of the protective device under certain conditions, and hence the protective devive according to the first mode of the present invention can be used as a protective device for various purposes such as voltage detection, optical detection, temperature detection and sweating detection. In particular, it can prevent overvoltage, and can be used as a protective device promising a high safety. The protective device according to the second mode of the present invention also makes it possible to make chip type protective devices smaller in size while ensuring their stable operation.

What is claimed is:

1. A protective device comprising a substrate, a heating element provided on the substrate, an insulating layer that covers the surface of the heating element, and a low-melting metal piece provided on the insulating layer, wherein said low-melting metal piece is sealed by an inner sealing portion having a lower melting point or lower softening point than the low-melting metal piece, and the inner sealing portion is covered with an outside casing that is provided leaving a gap between the outside casing and the inner sealing portion.

2. The protective device according to claim 1, wherein said substrate is formed of an inorganic material and said heat element is formed of an inorganic material.

3. The protective device according to claim 1, wherein said heating element is formed of a composition comprising a thermosetting insulating resin and conductive particles dispersed therein.

4. The protective device according to claim 1, wherein said insulating layer is formed of an insulating resin in which an inorganic powder with a high thermal conductivity is dispersed.

5. The protective device according to claim 1, wherein said low-melting metal piece is so designed as to blow at a plurality of points as a result of heat generation of the heating element.

6. The protective device according to claim 1, wherein said outside casing is formed of a liquid-crystal polymer or nylon 4/6.

7. A protective device comprising a substrate, a heating element provided on the substrate, an insulating layer that covers the surface of the heating element, and a low-melting metal piece provided on the insulating layer wherein said low-melting metal piece is sealed by an inner sealing portion having a lower melting point or lower softening point than the low-melting metal piece, and the inner sealing portion is sealed by an outer sealing portion having a higher melting point or higher softening point than the low-melting metal piece.

8. The protective device according to claim 7, wherein said substrate is formed of an inorganic material and said heat element is formed of an inorganic material.

9. The protective device according to claim 7, wherein said heating element is formed of a composition comprising a thermosetting insulating resin and conductive particles dispersed therein.

10. The protective device according to claim 7, wherein said insulating layer is formed of an insulating resin in which an inorganic powder with a high thermal conductivity is dispersed.

11. The protective device according to claim 7, wherein said low-melting metal piece is so designed as to blow at a plurality of points as a result of heat generation of the heating element.

12. An overcurrent-preventive protective device comprising a substrate, a low-melting metal piece provided on the substrate, an inner sealing portion which is formed of a material having a lower melting point or lower softening point than the low-melting metal piece and seals the low-melting metal piece, and an outside casing that covers the inner sealing portion, leaving a gap between the outside casing and the inner sealing portion.

13. The protective device according to claim 1 or 7, wherein said inner sealing portion is formed of a sealing compound having the action to remove a metal oxide film.

14. The protective device according to claim 13, wherein said sealing compound having the action to remove a metal oxide film comprises a solid flux.

15. An overvoltage protector comprising the protective device according to any one of claims 1–12 and a voltage detecting means; the heating element of said protective device being electrically excited to generate heat when the voltage detecting means detects a voltage exceeding the rated voltage.

* * * * *

US005712610C1

(12) REEXAMINATION CERTIFICATE (4605th)

United States Patent

Takeichi et al.

(10) Number: US 5,712,610 C1

(45) Certificate Issued: Jun. 25, 2002

(54) PROTECTIVE DEVICE

(75) Inventors: Motohide Takeichi; Norikazu Iwasaki; Yuji Furuuchi, all of Kanuma (JP)

(73) Assignee: Sony Chemicals Corp., Tokyo (JP)

Reexamination Request:
No. 90/005,834, Nov. 2, 2000

Reexamination Certificate for:

| | |
|---|---|
| Patent No.: | **5,712,610** |
| Issued: | **Jan. 27, 1998** |
| Appl. No.: | **08/562,685** |
| Filed: | **Nov. 27, 1995** |

(30) Foreign Application Priority Data

Aug. 19, 1994 (JP) ..... 6-195565
Nov. 30, 1994 (JP) ..... 6-323559

(51) Int. Cl.[7] ..... H01H 85/04; H01H 69/02

(52) U.S. Cl. ..... 337/290; 337/297; 337/416; 29/623

(58) Field of Search ..... 337/152, 153, 337/160, 182, 183, 184, 185, 221, 290, 297, 416; 29/623

(56) References Cited

U.S. PATENT DOCUMENTS

| | | | | |
|---|---|---|---|---|
| 3,168,632 A | 2/1965 | Baran et al. | ..... | 200/131 |
| 3,386,063 A | 5/1968 | Mansfield et al. | ..... | 337/191 |
| 4,494,104 A | 1/1985 | Holmes | ..... | 337/403 |
| 5,097,247 A | 3/1992 | Doerrwaechter | ..... | 337/405 |
| 5,099,219 A | 3/1992 | Roberts | ..... | 337/297 |
| 5,309,625 A | 5/1994 | Onishi | ..... | 29/623 |

FOREIGN PATENT DOCUMENTS

| | | | | |
|---|---|---|---|---|
| JP | 03046726 A | 2/1991 | ..... | H01H/37/76 |
| JP | 2-36026 | 8/1992 | ..... | H01H/37/76 |
| JP | 5-174678 | 7/1993 | ..... | H01H/37/76 |
| JP | 4-60047 | 8/1994 | ..... | H01H/85/00 |

*Primary Examiner*—Anatoly Vortman

(57) ABSTRACT

To obtain a protective device that can prevent overvoltage and at the same time has an excellent safety and also to make chip type protective devices smaller in size, this invention provides a protective device comprising a substrate, a heating element provided on the substrate, an insulating layer that covers the surface of the heating element, and a low-melting metal piece provided on the insulating layer. Particularly preferably the substrate and the heating element are each formed of an inorganic material. This protective device may be used in combination with a voltage detecting means making use of a zener diode, in such a way that the heating element of the protective device is electrically excited to generate heat when the voltage detecting means detects a voltage exceeding the rated voltage, whereby an overvoltage protector can be set up.

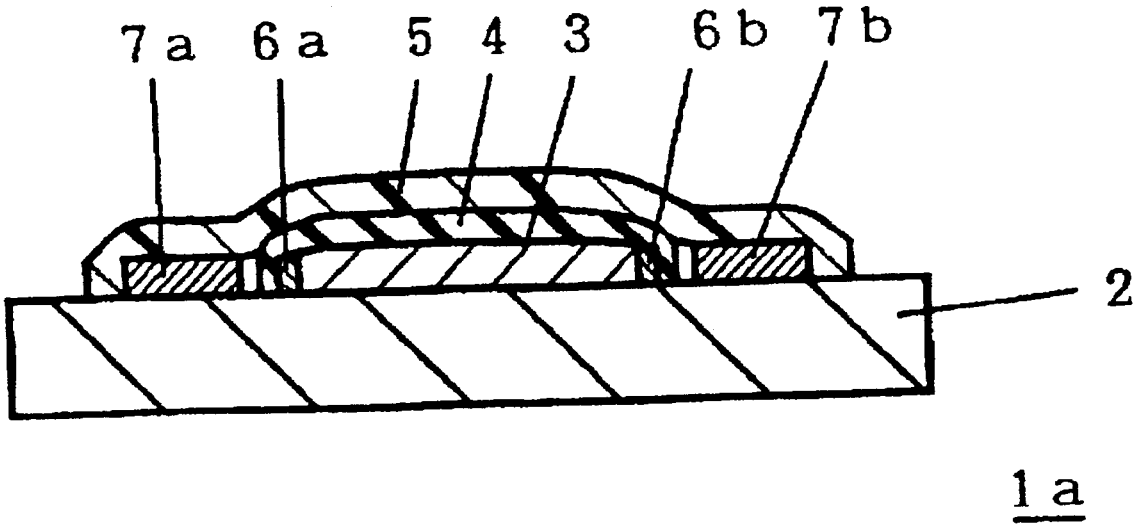

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–15 is confirmed.

* * * * *

US005712610C1

(12) REEXAMINATION CERTIFICATE (4825th)

United States Patent

Takeichi et al.

(10) Number: US 5,712,610 C2

(45) Certificate Issued: Jul. 29, 2003

(54) PROTECTIVE DEVICE

(75) Inventors: Motohide Takeichi, Kanuma (JP); Norikazu Iwasaki, Kanuma (JP); Yuji Furuuchi, Kanuma (JP)

(73) Assignee: Sony Chemicals Corp., Tokyo (JP)

Reexamination Request:
No. 90/006,346, Aug. 5, 2002

Reexamination Certificate for:

| | |
|---|---|
| Patent No.: | **5,712,610** |
| Issued: | **Jan. 27, 1998** |
| Appl. No.: | **08/562,685** |
| Filed: | **Nov. 27, 1995** |

Reexamination Certificate B1 5,712,610 issued Jun. 25, 2002

(30) Foreign Application Priority Data

Aug. 19, 1994 (JP) ..... 6-195565
Nov. 30, 1994 (JP) ..... 6-323559

(51) Int. Cl.[7] ..... H01H 85/04; H01H 69/02

(52) U.S. Cl. ..... 337/290; 337/297; 337/416; 29/623

(58) Field of Search ..... 337/152, 153, 337/160, 182–185, 122, 290, 297, 416; 29/623

(56) References Cited

U.S. PATENT DOCUMENTS

| | | | |
|---|---|---|---|
| 3,168,632 | A | 2/1965 | Baran |
| 3,377,448 | A | 4/1968 | Baumbach |
| 3,386,063 | A | 5/1968 | Mansfield, Jr. |
| 4,198,617 | A | 4/1980 | Hara |
| 4,494,104 | A | 1/1985 | Holmes |
| 5,097,247 | A | 3/1992 | Doerrwaechter |
| 5,099,219 | A | 3/1992 | Roberts |

FOREIGN PATENT DOCUMENTS

| | | |
|---|---|---|
| DE | 2808319 A1 | 6/1979 |
| JP | 36026/1992 | 8/1992 |
| JP | A 5-174678 | 7/1993 |

*Primary Examiner*—A. Vortman

(57) ABSTRACT

To obtain a protective device that can prevent overvoltage and at the same time has an excellent safety and also to make chip type protective devices smaller in size, this invention provides a protective device comprising a substrate, a heating element provided on the substrate, an insulating layer that covers the surface of the heating element, and a low-melting metal piece provided on the insulating layer. Particularly preferably the substrate and the heating element are each formed of an inorganic material. This protective device may be used in combination with a voltage detecting means making use of a zener diode, in such a way that the heating element of the protective device is electrically excited to generate heat when the voltage detecting means detects a voltage exceeding the rated voltage, whereby an overvoltage protector can be set up.

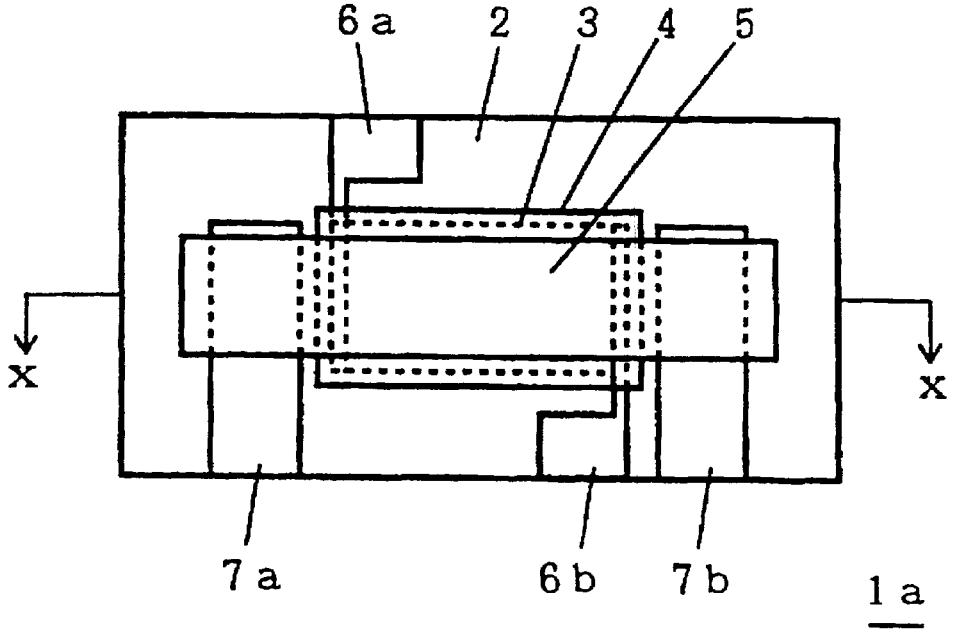

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–15 is confirmed.

* * * * *